US009291420B1

(12) United States Patent
Jensen et al.

(10) Patent No.: US 9,291,420 B1
(45) Date of Patent: Mar. 22, 2016

(54) SIMULATED WEAPON

(71) Applicant: Universal Electronics, Inc., Whitewater, WI (US)

(72) Inventors: Rick A. Jensen, North Prairie, WI (US); Jared R. Orvis, Bountiful, UT (US)

(73) Assignee: Universal Electronics, Inc., Whitewater, WI (US)

( * ) Notice: Subject to any disclaimer, the term of this patent is extended or adjusted under 35 U.S.C. 154(b) by 0 days.

(21) Appl. No.: 13/760,816

(22) Filed: Feb. 6, 2013

Related U.S. Application Data

(63) Continuation-in-part of application No. 13/293,404, filed on Nov. 10, 2011, now Pat. No. 8,602,785.

(60) Provisional application No. 61/414,721, filed on Nov. 17, 2010.

(51) Int. Cl.
*F41A 33/06* (2006.01)
*F41G 3/26* (2006.01)
*F41A 33/00* (2006.01)

(52) U.S. Cl.
CPC ..... *F41A 33/06* (2013.01); *F41A 33/00* (2013.01); *F41G 3/26* (2013.01)

(58) Field of Classification Search
CPC ..... F41A 33/00; F41A 33/02; F41A 33/06; F41A 21/10; F41A 21/12; F41A 5/18; F41A 3/2655; F41A 3/2666
See application file for complete search history.

(56) References Cited

U.S. PATENT DOCUMENTS

| | | | | |
|---|---|---|---|---|
| 4,481,862 | A | 11/1984 | Wiethoff et al. | |
| 4,539,889 | A | 9/1985 | Glock | |
| 4,825,744 | A | 5/1989 | Glock | |
| 4,893,546 | A | 1/1990 | Glock | |
| 5,552,240 | A * | 9/1996 | Derstine | 429/96 |
| 5,947,738 | A | 9/1999 | Muehle et al. | |
| 6,146,141 | A | 11/2000 | Schumann | |
| 6,682,350 | B2 | 1/2004 | Kehl et al. | |
| 6,869,285 | B1 | 3/2005 | Jones, II | |
| 7,291,014 | B2 | 11/2007 | Chung et al. | |
| 7,306,462 | B2 | 12/2007 | Metcalfe et al. | |
| 8,556,303 | B2 * | 10/2013 | Rajagopal et al. | 292/128 |
| 8,602,784 | B2 * | 12/2013 | Dvorak | 434/18 |
| 2003/0195046 | A1 | 10/2003 | Bartsch | |
| 2005/0260545 | A1 | 11/2005 | Schavone | |
| 2008/0127538 | A1 | 6/2008 | Barrett | |
| 2008/0187888 | A1 | 8/2008 | Jones et al. | |
| 2010/0003643 | A1 | 1/2010 | Seo | |

FOREIGN PATENT DOCUMENTS

| | | | |
|---|---|---|---|
| DE | 202005004362 | U1 | 7/2005 |
| GB | 2259559 | A | 3/1993 |
| WO | 2010065124 | A1 | 6/2010 |

* cited by examiner

*Primary Examiner* — Timothy A Musselman
(74) *Attorney, Agent, or Firm* — Boyle Fredrickson, S.C.

(57) ABSTRACT

A simulated weapon or firearm is provided that is formed with a mechanical operating or firing mechanism similar to that of an actual firearm. The firing mechanism is formed with components found in an actual firearm that are interconnected with components of an electronic mechanism that can monitor and control the mechanical operation of the simulated firearm. This allows for the mechanical operating mechanism to function in a manner similar to that of an actual firearm, while the electronic mechanism can introduce various mechanical failures that do not otherwise occur in the electronics-only operating mechanisms of prior simulated firearms. In addition, the operational cycles of the mechanical and electronic mechanisms are synchronized to provide a highly realistic feel to the simulated weapon.

17 Claims, 12 Drawing Sheets

SIMULATED WEAPON

CROSS-REFERENCE TO RELATED APPLICATION

This application claims priority as a continuation-in-part of U.S. Non-Provisional patent application Ser. No. 13/293,404, filed on Nov. 10, 2011, which in turn claims priority from U.S. Provisional Application Ser. No. 61/414,721, filed on Nov. 17, 2010, the entirety of which are hereby expressly incorporated herein by reference.

FIELD OF THE INVENTION

The present invention relates to a simulated weapon and, more particularly, to a simulated weapon which operates mechanically in conjunction with an electronic weapon monitoring system.

BACKGROUND OF THE INVENTION

When military and/or police personnel or other individuals are engaged in tactical training situations, or playing games to simulate these types of situations, they use simulated weapons that are designed to imitate the size and feel of the actual firearms that are used in the field.

In order to make the training simulation as realistic as possible, the simulated firearms that are utilized are designed to provide as realistic a feel as possible. To do so, many simulated weapons are formed from actual firearms that are retrofitted with various components and/or separate attachments to render the firearm suitable for simulated training. This allows the simulated firearm to retain the mechanical operation and feel of an actual firearm while enabling the firearm to fire simulated rounds suitable for training exercises.

While making a simulated firearm having a realistic feel, these retrofits for actual firearms have certain drawbacks. In particular, these retrofits require significant modifications to the firearm, as many components of the actual firearm are removed and replaced with components for the simulated firearms. In addition, some components for the simulated version of the actual firearm are required to be positioned on the exterior of the firearm, lessening the realistic feel and appearance of the simulated firearm.

Further, due to the reduced complexity of the operation of prior art simulated firearms, the authenticity of the operation of the firearms is reduced due to the lack of mechanical issues in the operation of the simulated firearms. While some simulated weapons or firearms may provide indications of an issue with the operation of the weapon requiring the individual to press a rest switch to correct the simulated issue, these simulations do not provide the real life experience of having to correct a mechanical issue with the weapon.

Therefore, it is desirable to develop a simulated weapon or firearm for use in various combat training and game-play simulations that is made to provide a realistic look, sound and feel to the operation of the weapon.

SUMMARY OF THE INVENTION

According to one aspect of the present disclosure, a simulated weapon or firearm is provided that is formed with a mechanical operating or firing mechanism similar to that of an actual firearm. The operating mechanism is formed with components found in an actual firearm that are interconnected with electronic components that can monitor the mechanical operation of the simulated firearm.

According to another aspect of the present disclosure, the electronic components of the simulated firearm are capable of controlling the mechanical operating mechanism. This allows for the mechanical operating mechanism to function in a manner similar to that of an actual firearm, including various mechanical failures that do not otherwise occur in the operating mechanisms of simulated firearms.

According to a further aspect of the present disclosure, the operational cycles of the mechanical and electronic mechanisms are synchronized to provide a highly realistic feel to the simulated weapon.

According to still another aspect of the present disclosure, the weapon includes a simulated magazine for a simulated weapon that includes a compartment therein for a compressed gas canister. The canister is operably and releasably interconnected to a memory module contained within the magazine that stores information relating to the simulated ammunition supplied by the magazine. The memory module includes a reset switch that can be selectively operated by the replacement of the compressed gas canister to enable the memory module and magazine to be reset for additional use. The memory module is additionally operably connected to a control module within the simulated weapon when the magazine is engaged with the weapon in order to receive signals from the control module regarding the simulated shots fired, to correspondingly update the information in the memory module concerning the amount of simulated ammunition remaining in the magazine.

According to still a further aspect of the present invention, the simulated magazine includes a valving mechanism operably connected to the compressed gas canister. When the magazine is engaged with the weapon the valving mechanism is engaged with an operating mechanism for the weapon, including the trigger. As the trigger is operated and the simulated weapon is fired, the movement of the trigger operates the valving mechanism to dispense an amount of the gas from the canister to provide a popping sound corresponding to the firing of the weapon, similar to the sounds created by the firing of a conventional paintball marker or gun. In addition, the gas released from the canister serves to reset/recock the mechanical operating mechanism for the simulated weapon in a manner and feel similar to an actual firearm.

Numerous other aspects, features, and advantages of the present disclosure will be made apparent from the following detailed description together with the drawings figures.

BRIEF DESCRIPTION OF THE DRAWINGS

The drawings illustrate the best mode currently contemplated of practicing the invention embodied by the present disclosure.

In the drawings.

DETAILED DESCRIPTION OF THE INVENTION

Figure 1:
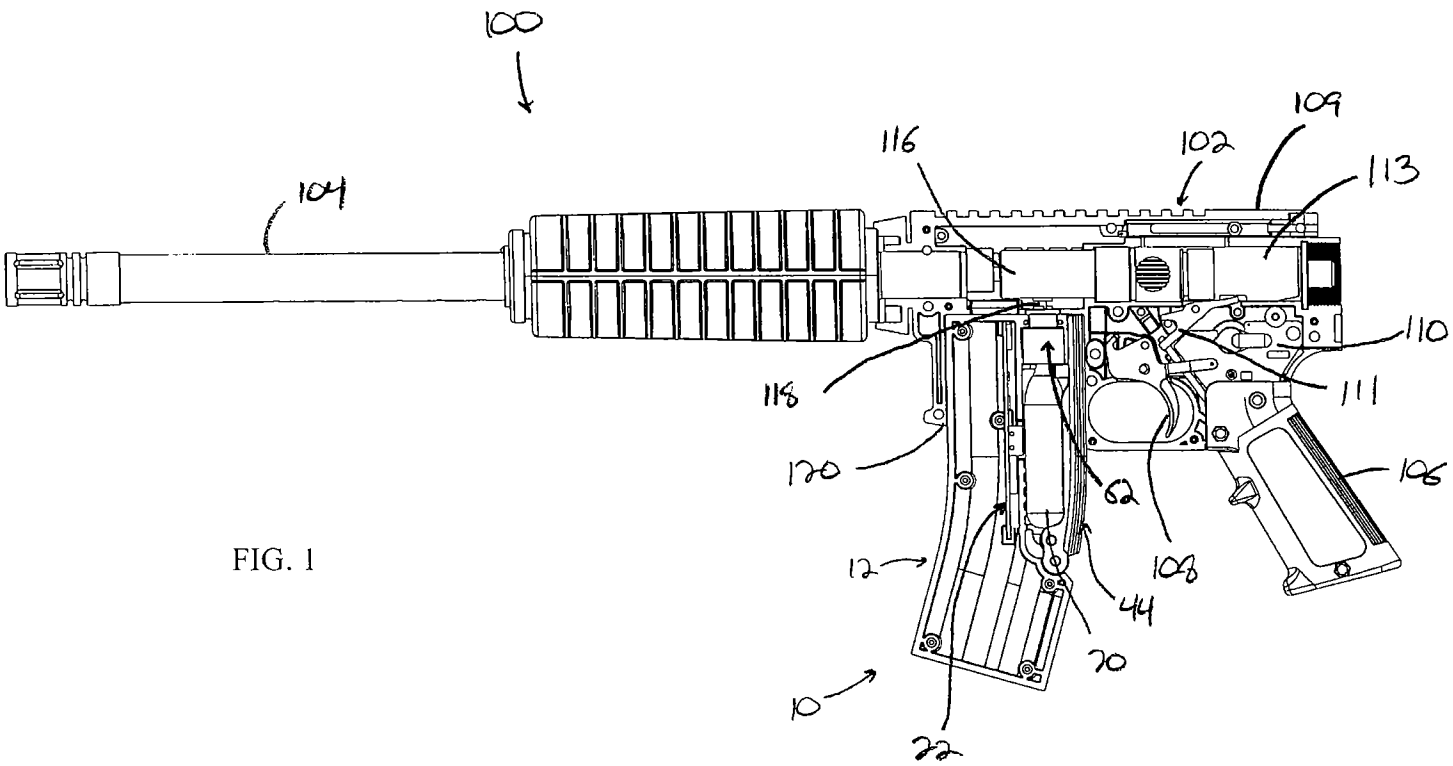
FIG. 1 is a cross-sectional view of a first embodiment of a simulated weapon constructed according to the present disclosure.

With reference now to the drawing figures in which like reference numerals designate like parts throughout the disclosure, in FIG. 1 a simulated magazine 10 is shown engaged with a simulated weapon 100. The weapon 100 can have any shape desired to simulate an actual weapon, and the magazine 10 can have a corresponding shape for use with the particular weapon 100.

In the illustrated embodiment shown in FIGS. 1-7, the weapon 100 includes a body 102 that can take various shapes such as a rifle or a pistol, as in the illustrated embodiment, a barrel or muzzle 104 extending outwardly from one end of the body 102 and a handle 106 disposed on the body 102 generally opposite the barrel 104. Adjacent the handle 106 is a trigger 108 used to operate the weapon 100. The weapon 100 can be configured to fire any type of simulated or non-lethal ammunition, such as a line-of-sight signal, e.g., an infrared, LED or laser light beam, among other types of simulated ammunition.

The body 102 houses an electronic monitoring and control mechanism 110 and a mechanical operating or firing mechanism 112. The mechanical mechanism 112 is controlled by the individual operating the weapon 100 in order to discharge a simulated shot from the weapon 100, while the electronic control mechanism 110 serves to determine and control the operating condition of the mechanical firing mechanism 112 and the weapon 100.

The trigger 108 is operably connected to a control module 110 disposed within the body 102 that monitors the operation of the weapon 100 in order to provide signals of any suitable type to the user, optionally such as visual signals via a display 109 on the body 102, and to other individuals or systems regarding the status of the weapon 100, such as wireless signals sent to a remote CPU, among others. The control module 110 also is connected to a firing mechanism 112 located within the body 102. In the illustrated embodiment, the firing mechanism 112 operates the control module 110 when the trigger 108 is operated to "fire" a round of simulated ammunition from the weapon 100 through the barrel 104. The firing mechanism 112 can be formed as desired, and in the illustrated embodiment includes a sear 111 connected to the trigger 108, and a hammer 113 engaged with the sear 111. In operation, the activation of the trigger 108 causes the sear 111 and hammer 113 to move and operate the control module 110. When operated by the trigger 108, the control module 110 consequently and simultaneously sends out signals to a valve 116 having a stem 118 that extends outwardly from the valve 116 into a magazine sleeve or well 120 formed on the body 102 for interconnection with the magazine 10, and to a firing mechanism (not shown) of the weapon 100, which causes the line-of-sight signal or other simulated round to be "fired" out of the weapon 100. The sleeve 120 is shaped to correspond to the configuration for the magazine 10 to enable a secure fit between the sleeve 120 and the magazine 10. The sleeve 120 can also include a suitable locking mechanism (not shown) that is operable to lock the magazine 10 in place within the sleeve 120 until manually disengaged by the user when it is desired to remove the magazine 10 from the sleeve 120. The sleeve 120 is shaped to correspond to the configuration for the magazine 10 to enable a secure fit between the sleeve 120 and the magazine 10. The sleeve 120 can also include a suitable locking mechanism (not shown) that is operable to lock the magazine 10 in place within the sleeve 120 until manually disengaged by the user when it is desired to remove the magazine 10 from the sleeve 120.

Looking now at FIGS. 1-6, in the illustrated embodiment the magazine 10 is constructed as a housing or shell 13 formed with a pair of halves 12 and 14 formed with apertures 15 therein, such as within channels 17 integrally formed on each half 12 and 14. The halves 12 and 14 can be formed from any suitable material, such as a metal or hard plastic, in order to withstand the repeated uses, similar to actual weapon magazines. To secure the halves 12 and 14 together to form the shell 13, the halves 12 and 14 can be positioned with the apertures 15 and channels 17 in each half 12 and 14 aligned with one another. In this position a number of fasteners 16 can be inserted through the apertures 15 and engaged with suitable engaging structures (not shown) located within the channels 17 in the halves 12 and 14 in any suitable manner. Alternatively, the shell 13 for the magazine 10 can be formed from a single component formed into the desired shape for the magazine 10 in any suitable manner.

One or both of the halves 12 and 14 may also include a display 30. The display 30 is operably connected to a data module 22 disposed within the magazine 10 and is operable to visually display the amount of simulated ammunition remaining within the magazine 10. While the display 30 can be disposed where desired on the magazine 10, in the illustrated embodiment the display 30 is located in a recessed position adjacent an engagement end 31 of the magazine 10 that is configured to be inserted within the sleeve 120 on the body 102 of the weapon 100. In this position, prior to insertion of the engagement end 31 within the magazine sleeve 120, the display 30 can illustrate to the user the amount of simulated ammunition remaining within the magazine 10. Once inserted within the sleeve 120, the display 30 is covered by the sleeve 120, preventing the display 30 from indicating the location of the weapon 100 and the user. Alternatively, the display 30 can be position where it is visible regardless of the engagement of the magazine 10 within the weapon 100, or the sleeve 120 can include a window (not shown) allowing the user to view the display 30 through the sleeve 120.

When assembled to form the magazine 10, the halves 12 and 14 define an interior 18 within which is disposed a compressed gas canister 20, and the data module 22. The canister 20, in one embodiment, is a standard carbon dioxide ($CO_2$) canister utilized in conventional paintball markers or guns. Different sized magazines 10 for different weapons 110 will allow the loading of between one (1) to four (4) standard twelve (12) gram canisters 20 containing liquefied $CO_2$ at a pressure of 600 psi to 1200 psi. The canister 20 includes a spout 60 at one end that can be punctured to enable the compressed gas in the canister 20 to exit the canister 20. While twelve (12) gram $CO_2$ canisters are shown, any suitable size canister 20, such as an eight (8) gram canister, for example, filled with any suitable gas may be employed.

The data module 22 is formed in any desired manner and in any suitable configuration, and includes a circuit board 24 containing the operating circuitry for the module 22 that interconnects a suitable electronic memory or storage medium 25, such as a flash drive, a replaceable power supply 26, a reset switch 28 and a data connector 30. The board 24 is secured within the interior 18 of the magazine 10 by engaging opposed ends and sides of the board 24 within slots 32 formed on the interior portions of each half 12 and 14. When inserted within the slots 32, the switch 28 is positioned within an opening 33 in a peripheral wall 34 of the magazine 10 formed by the halves 12 and 14. The switch 28 includes a base 35 positioned on and operably connected to the circuitry on the board 24 and an arm 36 that extend though the opening 33 into a canister compartment 38. The remainder of the module 22 is maintained within the peripheral wall 34, such that the module 22 is protected from the elements within which the magazine 10 can be used.

The arm 36 of the reset switch 28 is physically contacted and activated by the removal and/or insertion of a compressed gas canister 20 into the compartment 38. When a new canister 20 is inserted into the compartment 38, the canister 20 engages the arm 36 of the switch 28, which sends a signal to the storage medium 25 on the data module 22. This signal indicates the presence of a new canister 20, which causes the storage medium 25 to reset to the maximum number of simulated "shots" allowed for the magazine 10. However, the reset switch 28 can alternatively be activated by other means, such as an electronic signal (wired or wireless) received by the data module 22 and storage medium 25 or the engagement of a special key (not shown) with the switch 28 among others.

The storage medium 25 is capable of storing and rewriting the number of simulated "shots" remaining in the magazine 10 during usage of the magazine 10. The storage medium 25 is formed from any suitable type of high usage, durable memory device, such as inexpensive devices that can be powered by a separate power source or that do not require a separate power source, including, but not limited to flash memory devices, EEPORM (Electrically Erasable Programmable Read Only Memory) devices or FRAM (Ferroelectric Random Access Memory) devices, among others. The storage medium 25 can be set each game to have a certain maximum amount of shots per full magazine 10, e.g., an M-16 would have a maximum of thirty (30) simulated shots in the full magazine 10. Every time the simulated weapon 100 utilizing the magazine 10 fires a simulated "shot", the storage medium 25 subtracts one "shot" from this maximum amount. The storage medium 25 is also capable of maintaining the stored data on the number of simulated "shots" fired from the magazine 10 when the magazine 10 is taken out of one weapon and put into another to use the remaining ammunition, as in a real life situation.

The data coupling or connector 30 is positioned within the magazine 10 adjacent the engagement end 31 and serves to relay signals between the storage medium 25 on the data module 22 and the control module 110 of the weapon 100. The connector 30 can take any suitable form, but in the illustrated embodiment is formed as a magnetic connector, capable of creating an electronic connection for transferring data between the data module 22 and the control module 110. The use of the magnetic data connector 30 enables the connector 30 to be housed entirely within the peripheral wall 34 of the magazine 10, preventing damage to the connector 30 by the elements or by the repeated engagement of the magazine 10 with the weapon 100. Signals identifying the number of simulated "shots" fired from the weapon 100 are transmitted from the control module 110 to the storage medium 25 on the data module 22 via the connector 30. The connector 30 is disposed adjacent the engagement end 31 of the magazine 10 that is inserted into the magazine sleeve 120 of the associated weapon 100, and is capable of transmitting and receiving signals from the control module 110 disposed within the weapon 100 that is used to monitor and control operation of the simulated weapon 100. For example, among other connections, the control module 110 is in communication with the trigger 108 to determine when the operator has attempted to fire the simulated weapon 100, as well as other electronics that may be used on or with the weapon 100, such as a laser emitter (not shown), a display (not shown) and a signal transceiver (not shown), among others. As a result, when the simulated magazine 10 is inserted into the weapon 100, the storage medium 25 and the data module 22 will be in electrical communication with the control module 110 in the simulated weapon 110 via the connector 30. The connector 30 is selected to be a very high use connection that will allow information to be read and written from the control module 110 to the storage medium 25 and vice versa. In addition, the magazines 10, in their intended usage, are often slammed into the weapon sleeve 120, so the magazines 10 and the components of the magazines 10 need to be very durable. In one embodiment, to provide enhanced durability, the connector 30 is formed as a magnetic connector so there is essentially no wear or tear on the connector 30 as it does not need to be in physical contact to operate, and thus does not need to be exposed in a potentially damaging position.

To provide power to the data module 22 and electronic storage medium 25, in the illustrated embodiment the power supply 26 for the board 24 is formed with a receptacle 40 for receiving a battery 42 therein. The battery 42 can be any suitable type of battery capable of providing the necessary voltage to the board 24, and can be selected to be easily replaceable when necessary. Further, the battery 42 supplies power to the data module 22 only when the magazine 10 is not connected with any weapon 100, as power can be supplied to the data module 22 from the weapon 100 via the connector 30 when the magazine 10 is engaged with the weapon 100. Thus, the effective useful life of the battery 42 is greatly extended. Additionally, other types of power supplied 26 can be used, such as by using supercapacitors or radio frequency induction processes and associated power storage mechanisms (not shown), among others.

Referring now to FIGS. 1, 2, and 4-6, the canister compartment 38 is selectively opened and closed by the operation of a pivoting cover 44 attached to the peripheral wall 34 of the magazine 10. The cover 44 has a first end 46 including an aperture 48 formed therein in which a pivot pin 50 is disposed. Opposite ends of the pin 50 are engaged within aligned apertures (not shown) in the compartment 38 to secure the pin 50 to the magazine 10.

Figure 5:
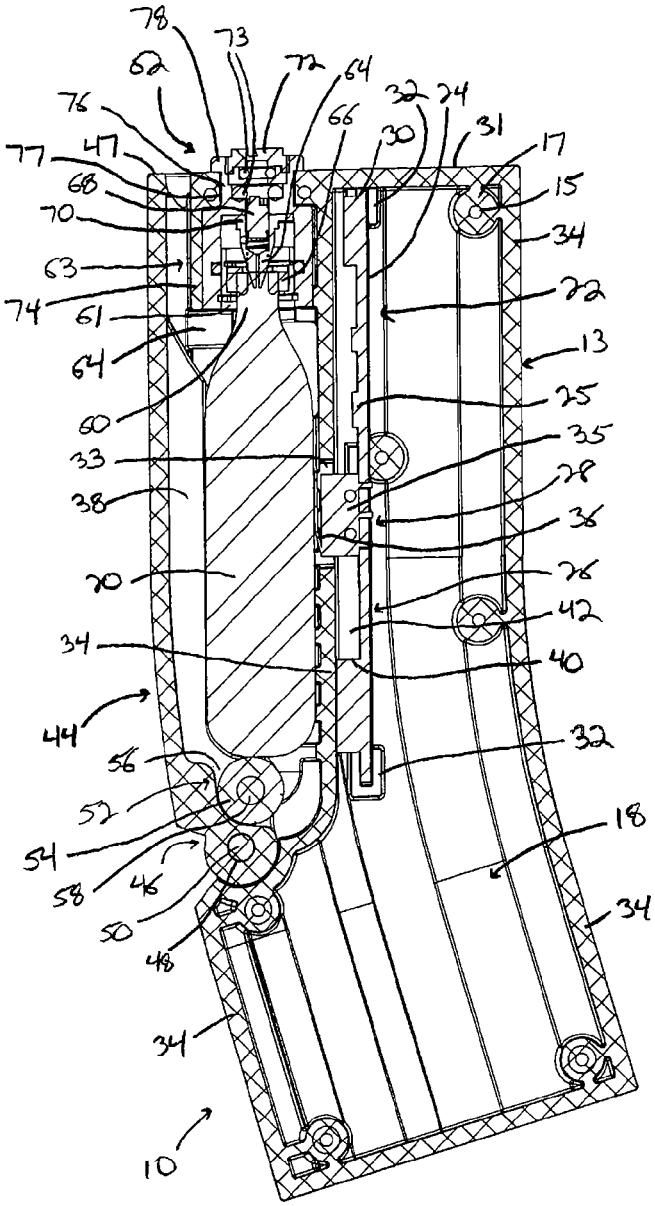
FIG. 5 is a cross-sectional view along line 5-5 of FIG. 4.

The first end 46 is formed with a cam 52 adjacent the pin 50. The cam 52 in the illustrated embodiment is formed as a wheel 54 pivotally disposed within a slot 56 formed in the first end 46 above the aperture 48, as best shown in FIG. 5, but could be formed as a static member, or as a curved portion of the cover 44 adjacent the first end 46. The wheel 54 is rotatably mounted on a shaft 58 extending across the slot 56, such that the wheel 54 can rotate freely within the slot 56. In the open position shown in FIG. 6, the compressed gas canister 20 can be positioned within the compartment 38 and engaged with the arm 36 of the reset switch 28. When the cover 44 is pivoted to the closed position shown in FIGS. 3-5, the wheel 54 is urged upwardly into contact with the bottom of the cartridge 20. Continued movement of the cover 44 towards the magazine 10 simultaneously presses the canister 20 against the arm 36 of the switch 28 and moves the spout 60 of the canister 20 into engagement with a valve mechanism 62 disposed within the compartment 38. In the closed position for the cover 44 shown in FIG. 5, a locking arm 64 on the cover 44 spaced near a second end 47 engages a complementary structure disposed within the compartment 38 in order to hold the cover 44 securely over the compartment 38, and the wheel 54 functions to maintain the canister 20 in secure engagement with the valve mechanism 62 and the arm 36 during use of the magazine 10, whether engaged with a weapon 100 or not.

As the cover 44 is closed over the compartment 38, the spout 60 of the canister 20 is urged into the inlet 61 of a housing 63 for the valve mechanism 62 for engagement with a piercing device 64 and a surrounding seal 66 to open the canister 20 and prevent gas from escaping out of the valve mechanism 62. Above the piercing device 64, the valve mechanism 62 includes shuttle valve 68 that can move along a channel 70 formed in the housing 63 between the piercing device 64 and an outlet 72 located opposite the inlet 61. The outlet 72 includes a pair of sealing members 73 therein which are engaged by the valve stem 118 of the weapon 100 when the magazine 10 is engaged within the sleeve 120 of the weapon 100. When the stem 118 is inserted into the outlet 72, the stem 118 is sealingly engaged with the sealing members 73 and presses the shuttle valve 68 towards the canister 20 against the pressure of the gas in the canister 20 to fluidly connect the canister 20 to the valve 116 in the weapon 100.

To hold the housing 63 in position within the compartment 38, the housing 63 includes a wide lower section 74 in which the inlet 61 is located, and a narrow upper section 76 that seats within an opening 77 formed in the compartment 38 at the engagement end 31 of the magazine 10. The upper section 76 includes a peripheral flange 78 that is positioned against the exterior of the magazine 10 to align the housing 63 within the compartment 38.

When the weapon 100 is fired, the actuation of the trigger 108 causes the control module 110 to operate the valve 116 to release an amount of the compressed gas from the canister 20 through the valve 116, providing an audible "pop" to signal the firing of the simulated ammunition round. The activation of the valve 116 can be done in a single shot, semi-automatic or fully automatic manner, depending upon the type of simulated weapon 100 being simulated or imitated. In an alternative embodiment for the magazine 10, the "pops" from the release of the compressed gas from the canister 20 can be generated directly by the valve mechanism 62 in the magazine 10, as opposed to by the mechanism 116 in the weapon 100, such that the mechanism 116 is not required and can be omitted.

Figure 3:
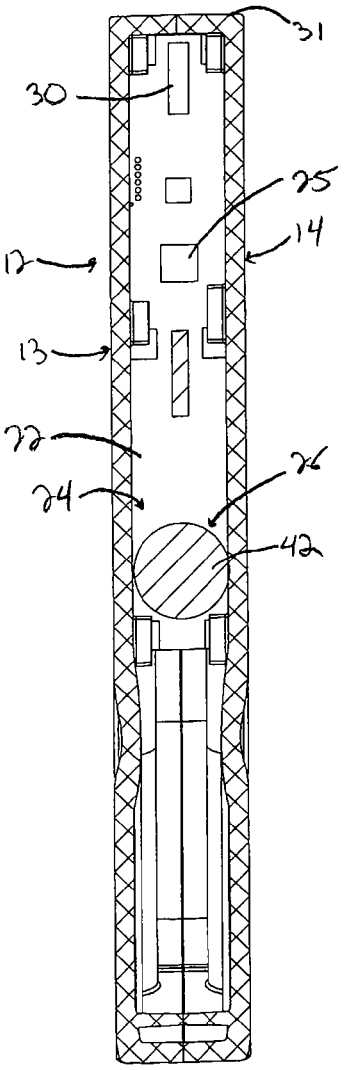
FIG. 3 is cross-sectional view along line 3-3 of FIG. 2.
Figure 2:
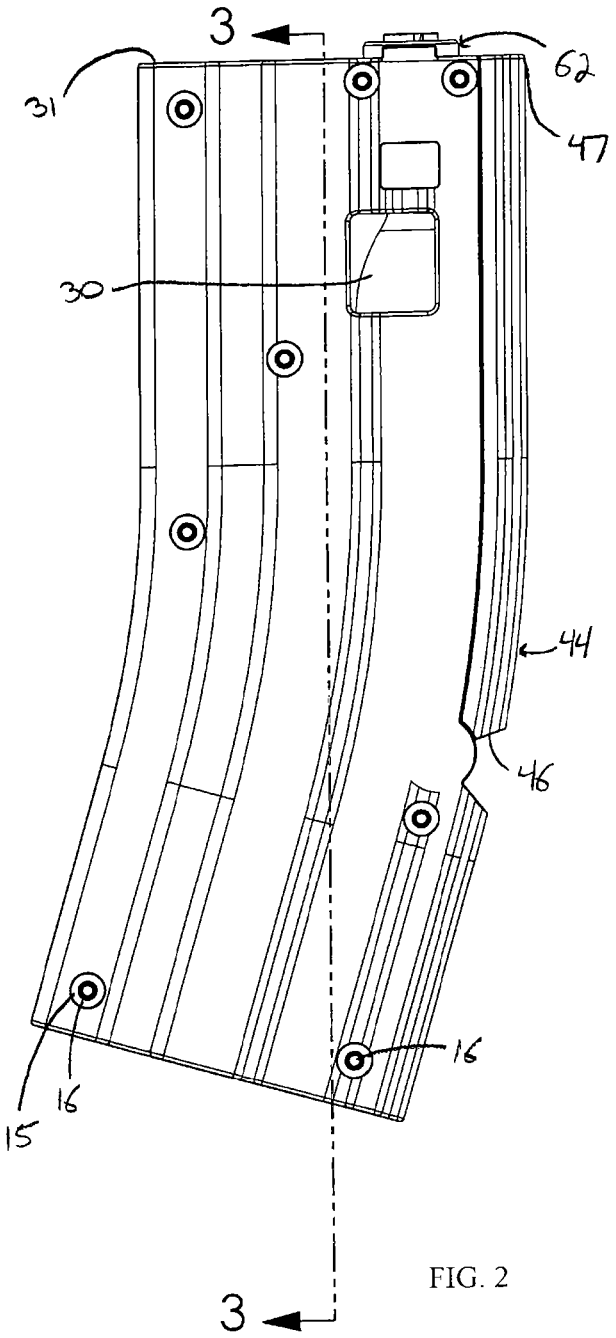
FIG. 2 is a side plan view of the magazine of FIG. 1.
Figure 4:
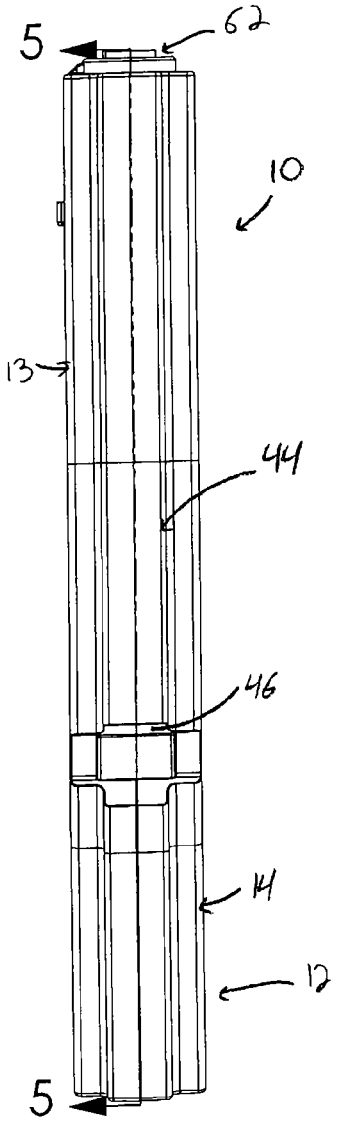
FIG. 4 is a front plan view of the magazine of FIG. 1.
Figure 6:
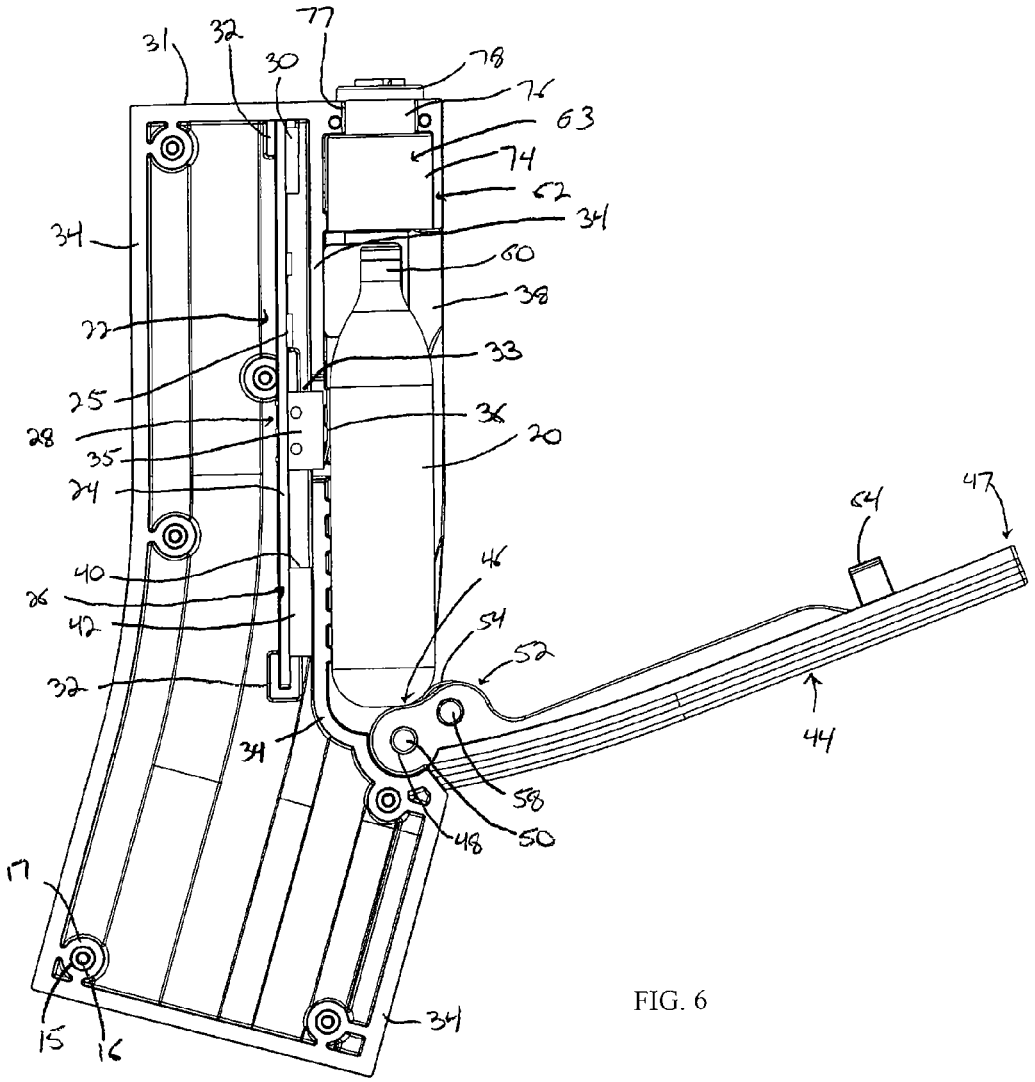
FIG. 6 is a cross-sectional view of the magazine of FIG. 1 in an open configuration.
Figure 7:
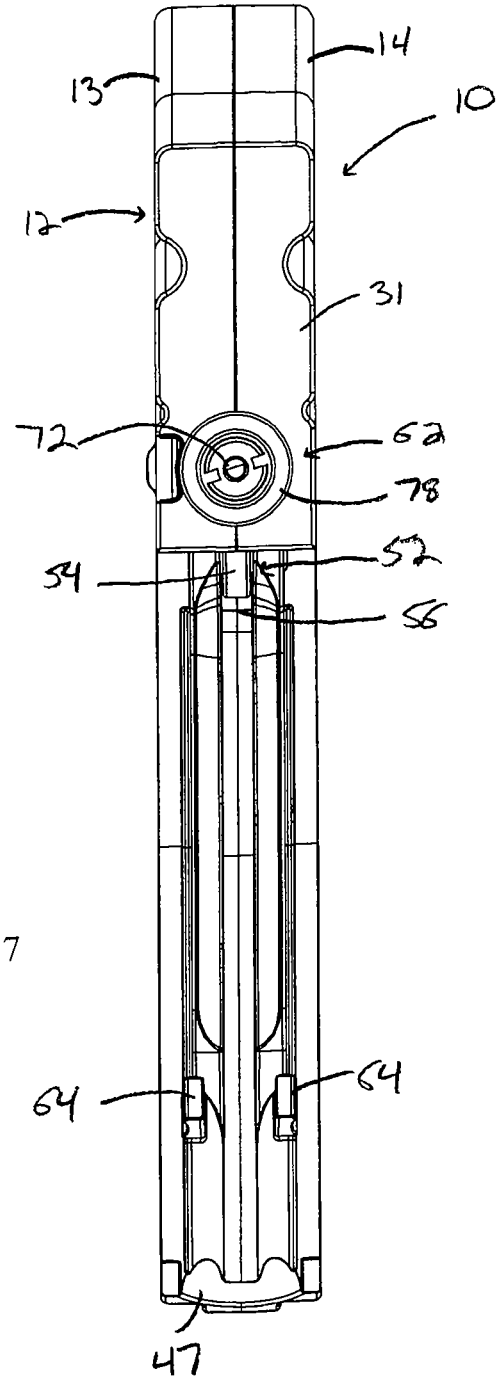
FIG. 7 is a top plan view of the magazine of FIG. 6.
Figure 8:
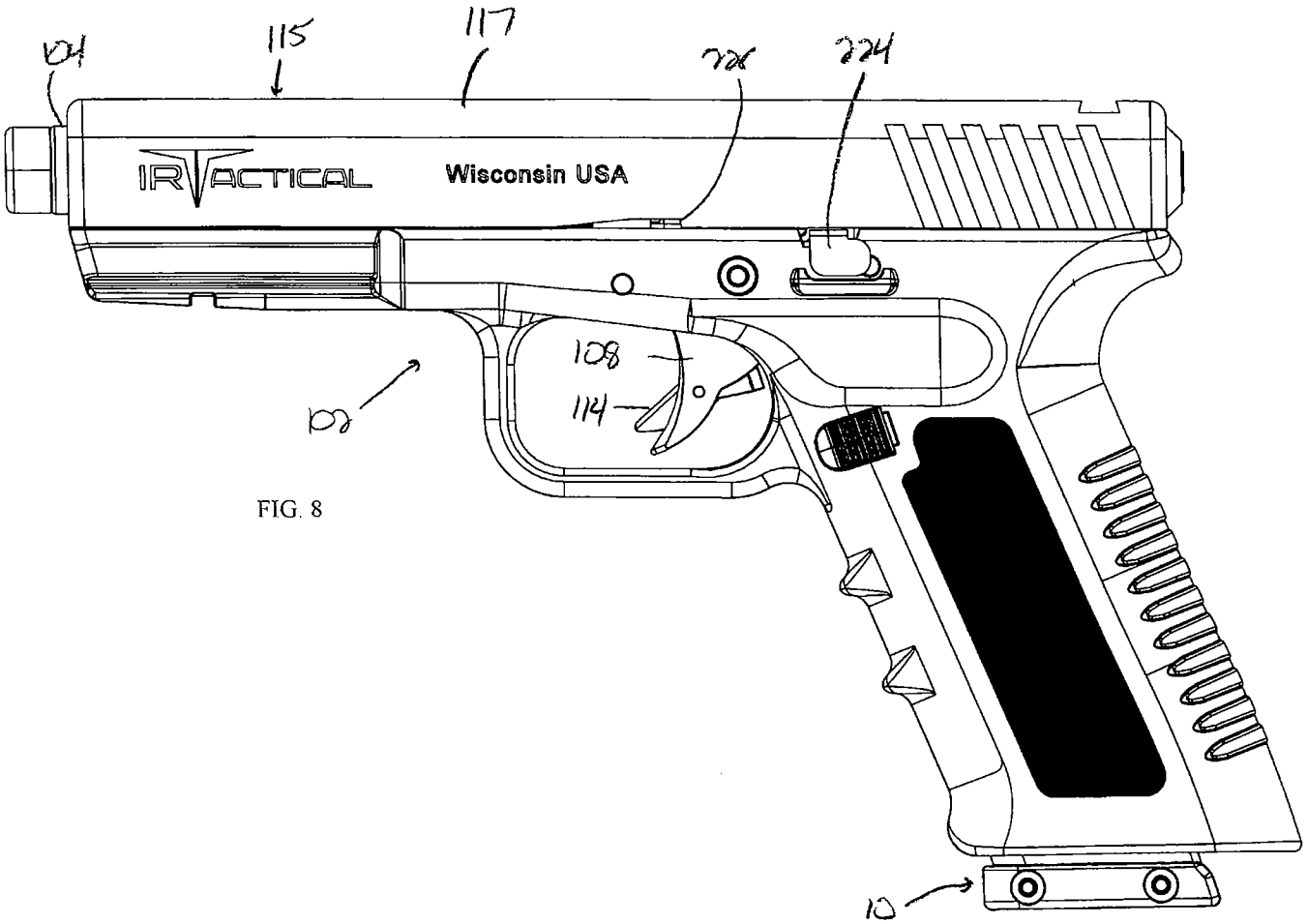
FIG. 8 is a side plan view of a second embodiment of the simulated weapon of FIG. 1.
Figure 9:
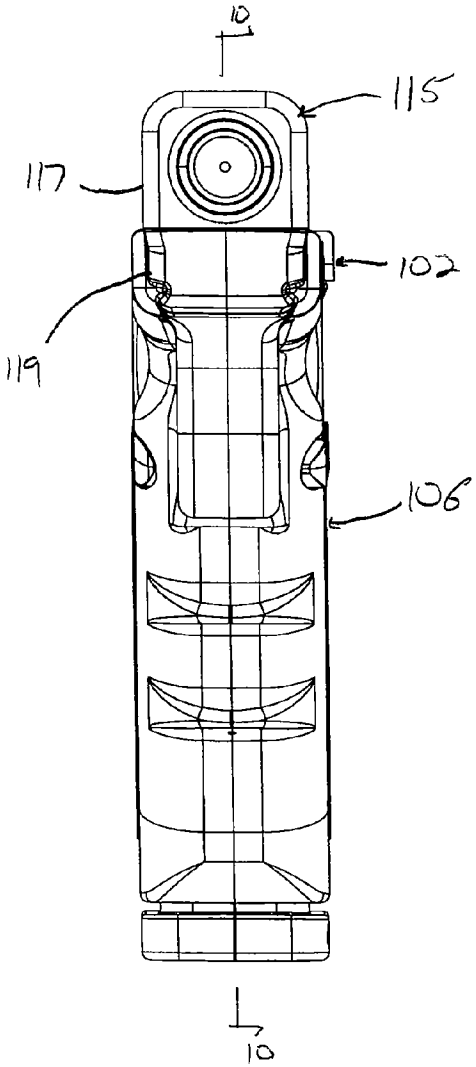
FIG. 9 is a front plan view of a simulated weapon constructed according to the present disclosure.

In use, during assembly of the magazine 10, the storage medium 25 is formatted for use with a particular type of weapon 100, such that upon any reset of the data module 22, the storage medium 25 will be reset to the selected value for the maximum number of "shots" available in the magazine 10. Power to enable the storage medium 25 to store and retain this information when the magazine 30 is not connected to the weapon 100 is provided by the battery 42 engaged with the storage medium 25 via the board 24. The magazine 10 can then be loaded with the cartridge 20. To do so, the cover 44 is pivoted away from the magazine 10 to expose the compartment 38, as shown in FIG. 6. The cartridge 20 is subsequently positioned within the compartment 38 with the spout 60 adjacent the valve mechanism 62 and the cover 44 is moved to the closed position, as shown in FIGS. 3-5.

In closing the cover 44 over the cartridge 20, the wheel 54 engages the cartridge 20 opposite the spout 60 and presses the cartridge both upwardly into the inlet 61 of the valve mechanism 62 and inwardly against the arm 36 of the reset switch 28. By depressing the arm 36, the data module 22 and storage medium 25 are reset/activated to indicate that the magazine 10 has a full amount of "shots" corresponding to the value written to the storage medium 25. This amount can be viewed on the display 30 on the magazine 10. When the cover 44 is locked into engagement with the compartment 38 via the arm 64, the canister 20 is fully compressed against the switch arm 36 and inserted into the valve mechanism inlet 61. In this position, the compressed gas in the canister 20 urges the shuttle valve 68 upwardly to close the mechanism 62 and prevent gas from escaping the magazine 10.

After loading the cartridge 20, the magazine 10 can be inserted within the sleeve 120 of the weapon 100. When inserted, the stem 118 of the valve mechanism 116 in the weapon 100 enters the outlet 72 to move the shuttle valve 68 against the pressure of the compressed gas to enable the gas to flow past the shuttle valve 68 and into the mechanism 116. Additionally, the connector 30 is positioned in magnetic connection with a suitable member (not shown) in the sleeve 120 to operably connect the connector 30 and data module 20 with the control module 110 within the weapon 100. The magazine 10 can be held in the engaged position within the sleeve 120 by the locking mechanism (not shown) disposed on the sleeve 120 that releasably engages the magazine 10.

When the weapon 100 is in use, the individual depresses the trigger 108 to fire one or more "shots" from the weapon 100. In doing so, the individual operates the control module 110 which sends a signal to the data module 22 via the magnetic connector 30. This signal modifies the storage medium 25 to change the number of remaining "shots" in the magazine in accordance with the number of "shots" that have been fired. As the storage medium 25 is rewritten with the "shots" that have been fired by the weapon 100, the data module 22 sends return signals to the control module 110 such that the control module 110 can illustrate the number of "shots" remaining in the magazine 10 on a suitable display (not shown) on the weapon 100. If the number of "shots" remaining within the magazine 10 as stored in the storage medium reaches zero, then the control module 110 in the weapon 100 receives a corresponding signal from the data module 22 that causes the control module 110 to prevent further operation of the weapon 100.

Once empty, the magazine 10 needs to be removed from the weapon 100 and either replaced with another magazine 10 or by removing and replacing the canister 20 in the empty magazine 10. To do so, the cover 44 is pivoted away from the compartment 38 to enable the empty canister 20 to be pulled out of the valve mechanism 62 and removed from the compartment 38 in order to be replaced by a fresh or full cartridge 20. Once the empty cartridge 20 is removed, the arm 36 of the reset switch 28 is allowed to extend away from the switch 28. The switch 28 can be reset when the full cartridge 20 is placed within the compartment 38 and engaged by the cover 44 as described previously. This sends a signal to the data module 22 to reset the value of the number of "shots" remaining in the magazine to the full predetermined amount for the magazine 10 as contained in the storage medium 25, thereby rendering the magazine 10 fully loaded.

Further, if the magazine 10 is removed from the weapon 100 prior to having all of the "shots" fired, the number of "shots" remaining in the magazine 10 is maintained on the storage medium 25 as a result of the power supplied by the battery 42 to the data module 22. Therefore, the magazine 10 can be reinserted into the weapon 100 or into another weapon 100 and provide the same number of "shots" that remained when the magazine 10 was initially removed from the weapon 100.

As the weapon 100 is fired using the trigger 108, the control module 110 operates the valve mechanism 116 in the weapon 100. The mechanism 116 allows for an amount of compressed gas to escape the magazine 10 in a manner that produces an audible "pop" corresponding to the "shot" that was fired. In one embodiment of the magazine 10, the maximum number of "shots" contained in the magazine 10 is less than the number of "pops" that can be obtained from the cartridge 20. In this manner, the magazine 10 ensures a full number of "pops" to accompany each "shot" that is taken.

Figure 10:
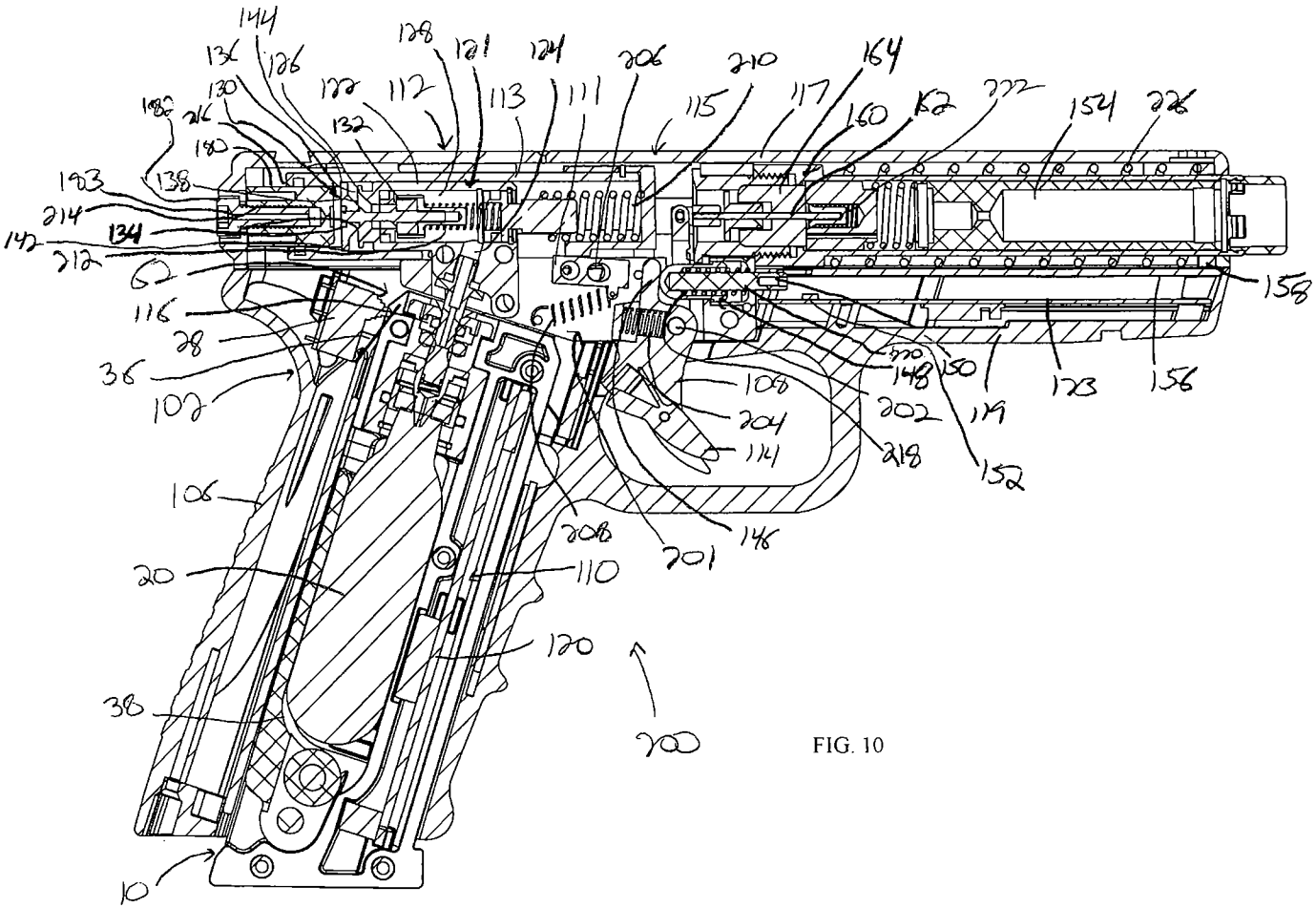
FIG. 10 is a cross-sectional view along line 10-10 of FIG. 9 showing the weapon in an at rest position.
Figure 11:
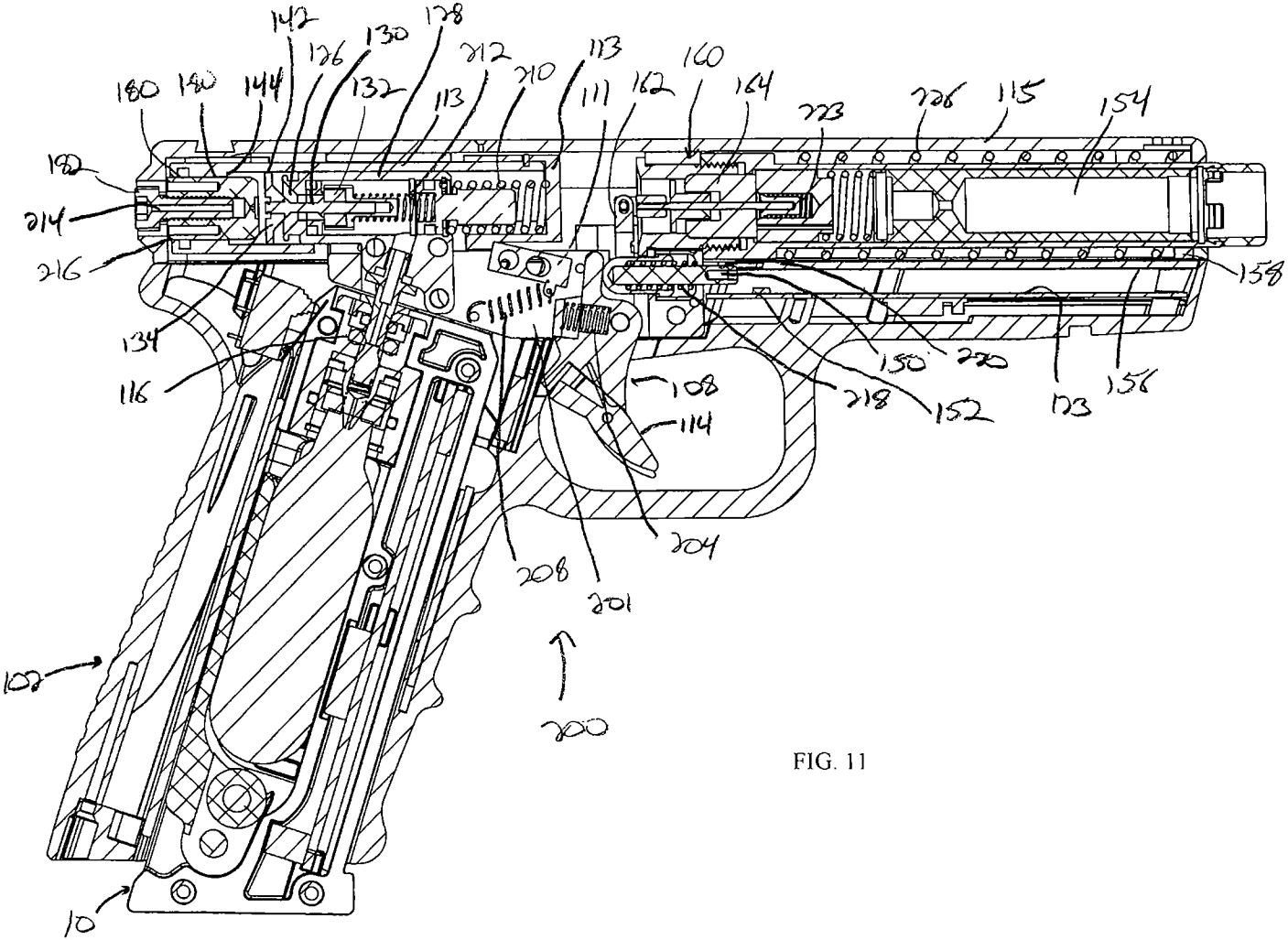
FIG. 11 is a cross-sectional view similar to FIG. 10 showing the weapon in a cocked position.

Looking now at FIGS. 8-14, in a second embodiment of the weapon 100 which takes the form of a pistol 200 having a internal housing 201 within and on which the firing mechanism 112 can be formed as desired, and in the illustrated embodiment includes a sear 111 operably engaged with the trigger 108, and a hammer 113 engaged with the sear 111. As best shown in FIG. 10, the mechanism 112 also includes a slide 115 forming the upper portion 117 of the body 102 that is disposed around and slidable with respect to the hammer 113, and which is slidable relative to the lower portion 119 of the body 102 including the trigger 108 and the handle 106.

In operation, the mechanical mechanism 100 is actuated by the trigger 108 disposed on the internal housing 201. The trigger 108 is pivotally attached to the internal housing 201 by pivot pin 202 and is biased to an outward position by a spring 204 connected between the trigger 108 and the internal housing 201. The trigger 108 also includes a safety 114 secured thereto that prevents the operation of weapon 100 by preventing the movement of the trigger 108 until the safety is disengaged by the individual using the weapon 100, such as by depressing the safety 114 prior to depressing the trigger 108.

The pivoting activation of the trigger 108 causes the trigger 108 to pivot into engagement with the sear 111 and hammer 113 to move to simulate a shot being fired from the weapon 100. In particular, when depressed, the trigger 108 pivots rearwardly to contact the sear 111 which is pivotally secured to the internal housing 201 within the body 102 adjacent the trigger 108 by pin 206. The sear 111 is biased into a position where the sear 111 can engage the hammer 113 by a spring 208 engaged between the internal housing 201 and the sear 111.

The movement of the sear 111 by the trigger 108 disengages the sear 111 from the hammer 113, allowing the hammer 113 to move forwardly along the housing 201 as a result of a the bias of a spring 210 disposed within the hammer 113 to extend between the internal housing 201 and the hammer 113 and acting on the hammer 113.

The hammer 113 is slidably disposed around the internal housing 201 and a valve assembly 121 located within the internal housing 201. The valve assembly 121 includes a valve housing 122 secured to and formed as part of the internal housing 201 and including a gas inlet 124 and a gas outlet 126.

The valve inlet 124 extends outwardly from the assembly 121 through the internal housing 201 and is engaged by a valve assembly 62 disposed in the magazine 10. A valve 116 within the valve assembly 62 operated by the control mechanism 110/control module 120 supplies compressed gas from the magazine 10 to the inlet 124 in response to the operation of the trigger 108 in a manner to be described.

The valve outlet 126 extends rearwardly from the housing 122, is disposed in axial alignment with the internal housing 201 and includes a recess 128 formed therein. A poppet valve 130 is disposed within the recess 128 and includes a seal 132 disposed thereon which can selectively open and close the outlet 126 depending upon the position of the poppet valve 130. The valve 130 is biased to a closed position by a spring 212 located within the recess 128 and extending between the internal housing 201 and the seal 132.

Opposite the seal 132, the poppet valve 130 includes head 134 that is selectively engageable with the outer end 136 of the outlet 126. In the illustrated embodiment, the head 134 includes an inwardly tapering surface 138 that mates with a conical surface 140 at the outer end 136 of the outlet 126. The head 134 also includes a peripheral rim 142 that extends around the head 134 and seats against the outer end 136 of the outlet 126 when the valve 130 is opened. The head 134 does not completely cover the outer end 136 of the outlet 126 when engaged therewith, as the head 134 includes gaps (not shown) therearound to enable gas to exit the internal housing 201 through the outlet 126 and past the head 134 of the valve 130.

Adjacent the head 134 of the poppet valve 130 is disposed a valve piston 180 that is affixed to the slide 115, such as by a fastener 182 inserted within a corresponding bore 183 formed in the piston 180. The diameter of the valve piston 180 is slightly less than that of the head 134 including the rim 142, such that the rim 142 extends radially outwardly beyond the piston 180. With this construction, the piston 180 can slidably move within an open end 216 of the hammer 113. Additionally, the piston 180 and fastener 182 form a reduced diameter passage 214 therethrough, to enable gas exiting the outlet 126 to pass through the piston 180 and out of the pistol 200.

When the hammer 113 moves forwardly around the internal housing 201 as a result of the operation of the trigger 108, an engagement surface 144 disposed on the interior of the hammer 113 around the open end 216 moves forwardly along the piston 180 into contact with the rim 142 on the poppet head 134. The movement of the engagement surface 144 and the hammer 113 causes the poppet valve 130 to move forwardly relative to the valve housing 122 and the internal housing 201 until the head 134 of the poppet valve 130 is seated fully within the outlet 126. At this point, the movement of the hammer 113 is stopped due to the engagement of the poppet valve 130 with the outlet 126, and the corresponding engagement of the hammer 113 with the rim 142. Also, the hammer 113 engages the internal housing 201 directly at a location below the seal 132 to stop the forward movement of the hammer 112.

Separately from the operation of the mechanical mechanism 112 by the movement of the trigger 108, the movement of the trigger 108 also causes a flange 146 formed on the trigger 108 to contact a trigger sensor 148 disposed within the body 102 adjacent the trigger 108 and opposite the sear 111. The trigger sensor 148 is slidably mounted to the body 102 and biased by a suitable biasing member 218 extending between the body 102 and the sensor 148 to a position adjacent the trigger 108. The trigger sensor 148 includes a trigger sensor magnet 150 disposed in a pin 220 extending outwardly from the sensor 148 which can be moved to a position over a sensing device 152, such as a Hall effect sensor, operably connected to the control board 120 via the circuit board 123. The movement of the sensor magnet 150 over the sensing device 152 as a result of the engagement of the sensor 148 by the trigger 108 enables the circuit board 123 to register that the trigger 108 has been operated to fire a simulated "shot" from the weapon 100. The control module 120/circuit board 123 can then operate an emitter 154 disposed within the barrel 104 at the front of the weapon 100 to emit the laser, infrared or other type of light or simulated round from the weapon 100, and consequently reduce the number of stored simulated "shots" remaining in the weapon 100. Additionally, the board 123 in the illustrated embodiment is configured to wirelessly communicate with the control module 110 in the magazine 10 in order to accurately record the operation of the pistol 200.

This wireless connection can also be configured to communicate with devices (not shown) located exterior to the pistol 200 in order to monitor the operation of the pistol 200. Alternatively, the board 123 can communicate with the module 110 via a suitable wired or magnetic connection disposed in the body 102 and completed when the magazine 10 is inserted into the body 102.

The circuit board 123 also includes a slide sensing device 156, such as a Hall effect sensor, disposed thereon or operably connected thereto. The slide sensing device 156 can sense a slide sensor magnet 158 operably connected to the slide 115 when the slide 115 is moved as a result of the operation of the trigger 108, in a manner to be described. This device 156 provides a redundant record of the simulated shots being fired from the weapon 100. In addition, the device 156 enables the circuit board 123 to register when the slide 115 has been moved without the trigger 108 being operated, such as when a simulation involving the manual chambering of a round is being performed, such as when the pistol 200 is initially being prepared for firing, to subtract a simulated "round" or "shot" from those remaining in the magazine 10.

Figure 13:
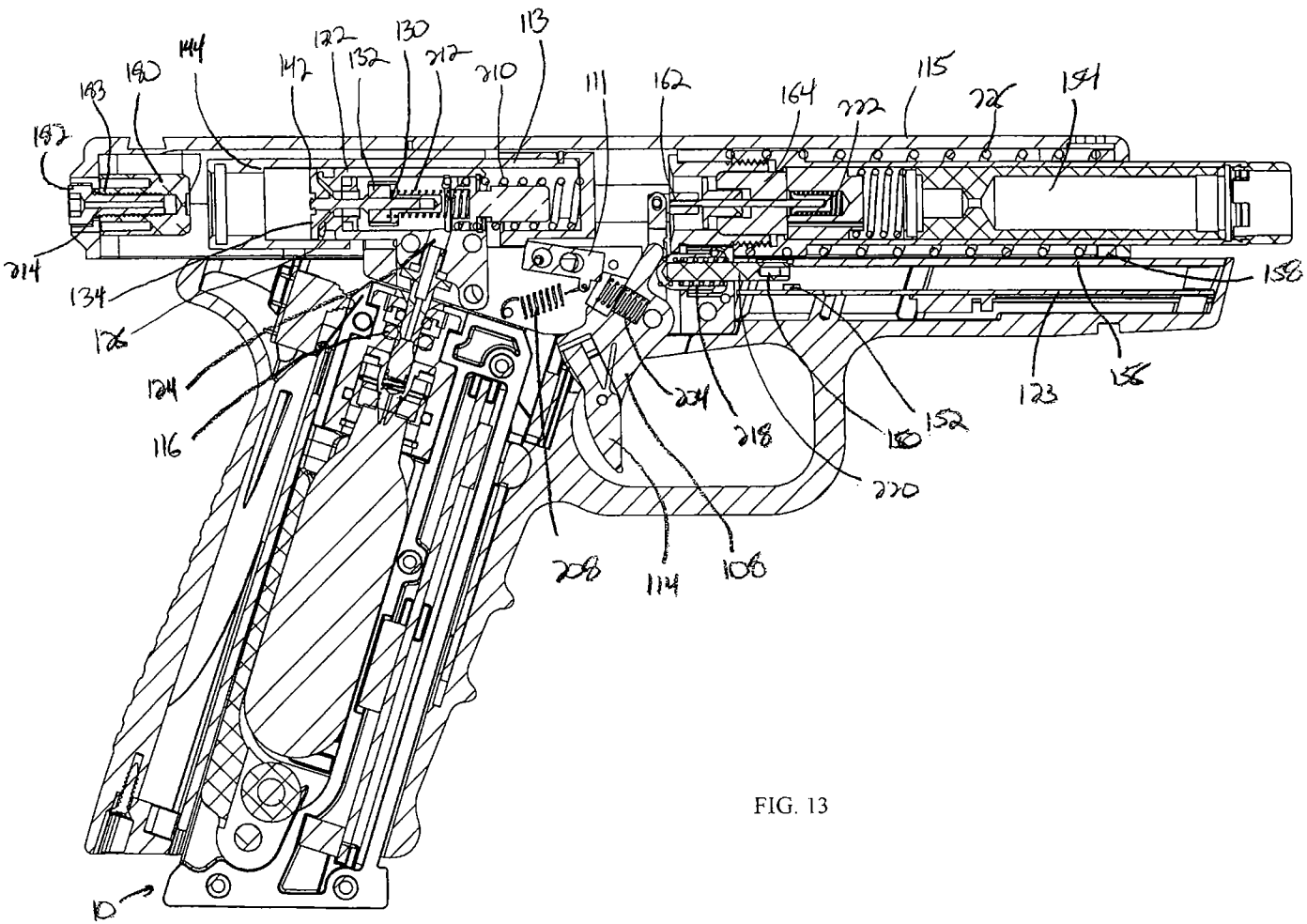
FIG. 13 is a cross-sectional view similar to FIG. 10 showing the weapon in a recoil position.
Figures 14, 15:
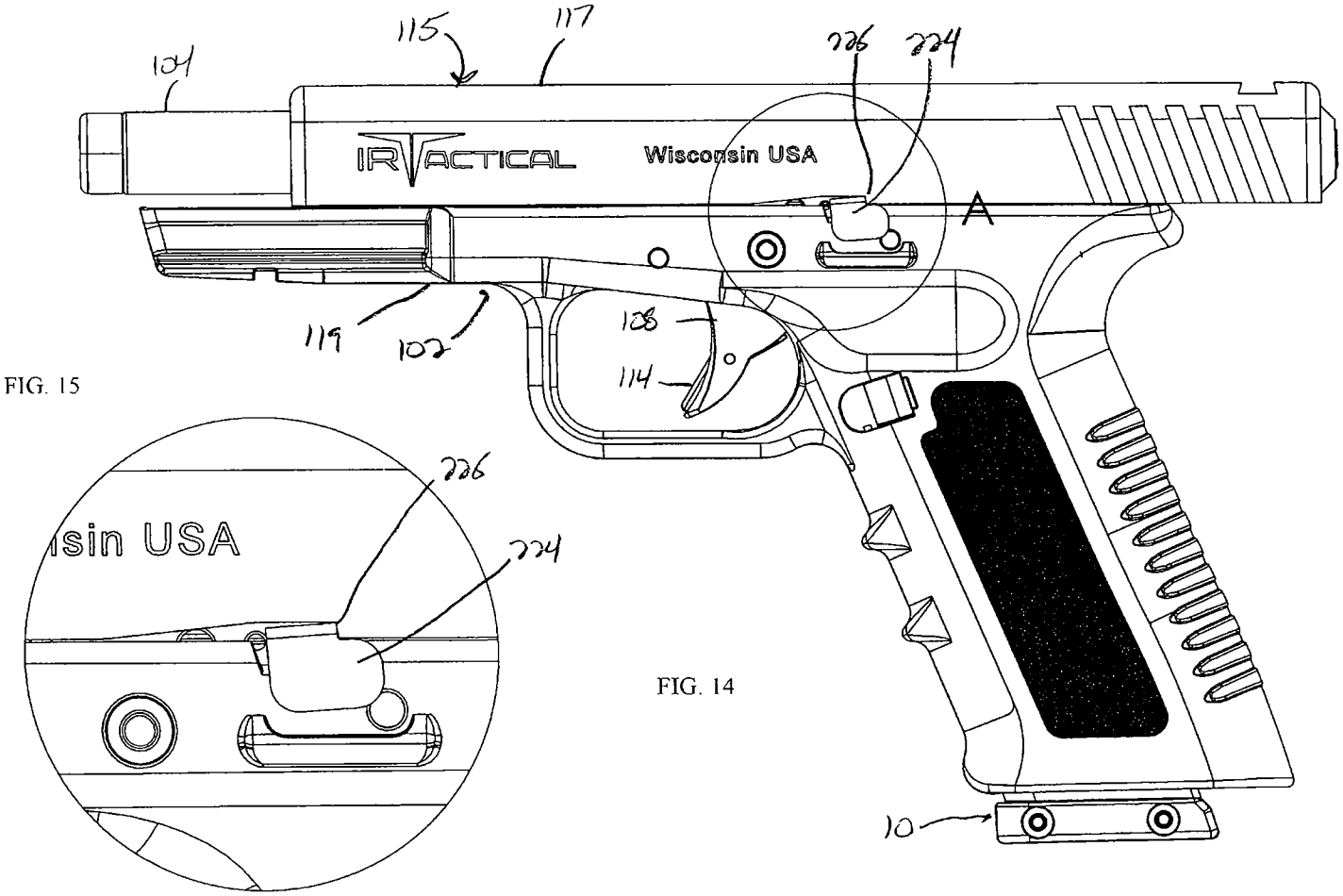
FIG. 14 is a side plan view showing the weapon of FIG. 8 in a locked position.
FIG. 15 is a circular sectional view along line 15-15 of FIG. 14.

Referring now to FIGS. 13-15, the body 102 also includes a locking mechanism 160 disposed therein and operably connected to the slide 115. The locking mechanism 160 includes a linkage 162 attached to the slide 115 that can be selectively operated by an electromechanical solenoid 164 secured within the body 102 separate from the slide 115. The operation of the solenoid 164 is controlled by the circuit board 120 such that the solenoid 164 can be selectively energized, and optionally remotely de-energized, to move the linkage 162 acted on by the solenoid 164 and prevent movement of the slide 115, causing the weapon 100 to be rendered inoperable. The de-energizing of the solenoid 164 allows a spring 222 to move the linkage 162 rearwardly to pivot a lock 224 into a position where the lock 224 engages a corresponding notch 226 in the slide 115 (FIGS. 14 and 15), preventing further movement of the slide 115 and operation of the pistol 200 until the lock 224 is disengaged. In this manner, the control mechanism 110 including the control module 120/circuit board 123 can be operated to affect the mechanical operating mechanism 112 in a manner that simulates a misfire or jam in the weapon 100. The individual must then clear the simulated jam, such as by manually moving the slide 115 to place the pistol 200 in the firing configuration of FIG. 11, or removing and replacing the magazine 10 in order to re-energize the solenoid 164 and reset the linkage 126 and lock 224 of the locking mechanism 160 and replace the weapon 100 into an operational condition. In addition, in the same manner the control mechanism 110 can cause the operation of the mechanical operating mechanism 132 when the number of simulated rounds in the magazine 10 has been reached, as determined by the control mechanism 110 in response to the operation of the weapon 100, to signal that the magazine 10 is empty and needs to be replaced with a "full" magazine 10, as occurs when a real magazine is depleted.

Figure 12:
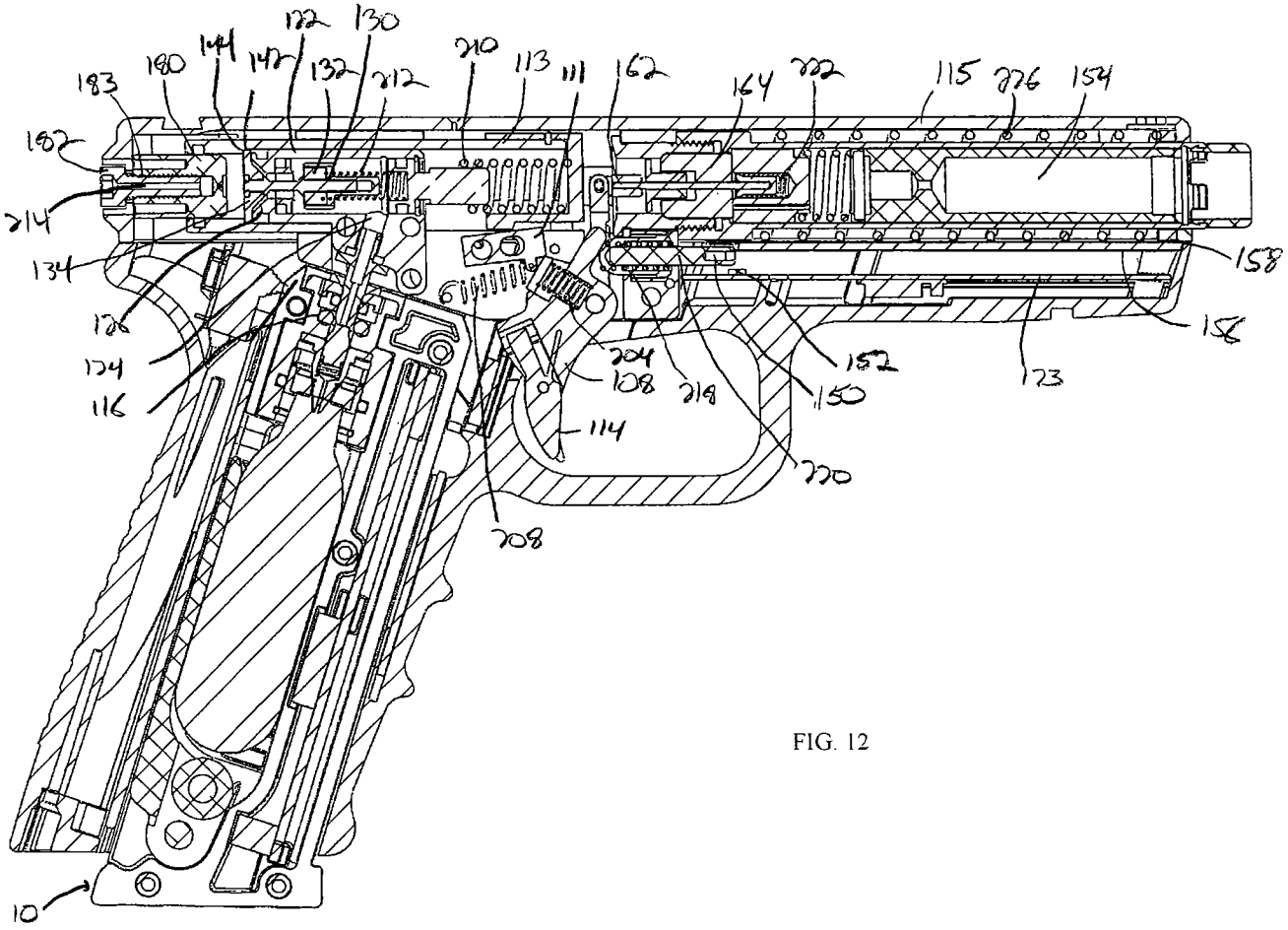
FIG. 12 is a cross-sectional view similar to FIG. 10 showing the weapon in a firing position.

As shown in FIG. 12, after movement of the hammer 113 has been stopped by engagement with the valve housing 122 on the internal housing 201, or simultaneously with the movement of the hammer 113, the control mechanism 110 operates the valve assembly 62 and valve 116 in the magazine 10. This operation causes a predetermined volume of compressed air or gas to be dispensed from the magazine 10 into the inlet 124 of the valve housing 122 to simulate the firing of a shot from the weapon in a semi-automatic manner. In particular, the pressure of the gas entering the housing 122 passes through the outlet 126 around the head 134 on the poppet valve 130 seated in the outlet 126 of the housing 122. The gas then contacts and urges the piston 180 rearwardly away from the internal housing 201 against the bias of a spring 226 disposed around the barrel 104 and extending between the barrel 104 and the front end of the slide 115, providing the recoil action for the pistol 200.

The pressure of the gas released into the valve housing 122 within the internal housing 201 also contacts the seal 132 of the valve 130 to urge the valve 130 out of the outlet 126, in conjunction with the force of the spring 216. The movement of the poppet 130 causes the hammer 113 to move rearwardly away from the barrel 104 due to the engagement of the rim 142 of the head 134 with the engagement surface 144 of the hammer 113. The hammer 113 is moved rearwardly against the bias of the spring 210 to a position where the sear 111 can be re-engaged with the hammer 113. In this configuration, the pistol 200 is ready for operation to fire a subsequent simulated shot.

The pressure exerted by the gas on the various internal components of the pistol 200 is dissipated as the gas exits the pistol 200 through the passage 214 formed within the piston 180 and the fastener 182. This reduction in pressure enables the spring 226 to move the slide 115 forward to the ready to fire position, unless otherwise engaged by the slide lock 224.

In this embodiment, the operation of the electronic monitoring and control mechanism 110 and the mechanical operating or firing mechanism 112 are synchronized to provide a simulated weapon 100 having a realistic feel. In particular, the operational cycle of the electronic mechanism or module 110 is approximately ninety (90) milliseconds while the cycle of the mechanical firing mechanism 112 is approximately twenty (20) milliseconds. As such, because the length of time required for an individual to manually operate the weapon 100 is significantly longer than the operational cycles of the mechanisms 110, 112, the overall operation of the weapon 100 is virtually identical in feel to that of a conventional weapon.

In still another embodiment, the magazine 10 can be constructed to accommodate multiple cartridges 20 within one or more compartments 38 having one or more switches 28 and valve mechanisms 62 therein to be engaged by the cartridges 20 for use with weapons 100 having larger ammunition capacities.

Various other embodiments of the present invention are contemplated as being within the scope of the filed claims particularly pointing out and distinctly claiming the subject matter regarded as the invention.

The invention claimed is:

1. A simulated firearm comprising:

a. a body;

b. a source of pressurized gas disposed within a magazine releasably disposed within the body, the magazine comprising:

i) a shell;

ii) a cover pivotally connected to the shell to selectively engage the shell and enclose a compartment adapted to receive a compressed gas canister therein; and iii) a cam disposed on the cover, wherein the cam is adapted to urge the compressed gas canister upwardly and inwardly into secure engagement within the compartment when the cover is engaged with the shell;

c. a mechanical firing mechanism disposed within the body and operably connected to the source of pressurized gas; and d. an electronic control mechanism operably connected to the source of pressurized gas and the mechanical firing mechanism.

2. The simulated firearm of claim 1 wherein the source of pressurized gas is connected to the mechanical firing mechanism by at least one valve.

3. The simulated firearm of 2 wherein the at least one valve is directly connected to the mechanical firing mechanism.

4. The simulated firearm of claim 3 wherein the electronic control mechanism is operably connected to a slide disposed on the body.

5. The simulated firearm of claim 4 wherein the electronic control mechanism includes a locking mechanism that is selectively operable to prevent movement of the slide with respect to the body.

6. The simulated firearm of claim 3 wherein the mechanical firing mechanism includes a hammer that is selectively mechanically engaged with the at least one valve.

7. The simulated firearm of claim 1 wherein the electronic control mechanism includes at least one sensor to detect the operation of the mechanical firing mechanism.

8. The simulated firearm of claim 7 wherein the at least one sensor is operably engaged with the trigger.

9. The simulated firearm of claim 7 wherein the at least one sensor is operably engaged with the slide.

10. The simulated firearm of claim 1 wherein the electronic control mechanism is disposed partially within the magazine and partially within the body, and wherein the portions disposed within the magazine and the body are operably connected to one another.

11. The simulated firearm of claim 10 further comprising a wireless connection in the body between the portions of the electronic control mechanism.

12. A method of firing a shot from a simulated firearm comprising the steps of:

a. providing the simulated firearm of claim 1; and b. operating the mechanical firing mechanism to fire a simulated shot from the simulated firearm.

13. The method of claim 12 further comprising the step of operating the electronic control mechanism to monitor the operation of the mechanical firing mechanism.

14. The method of claim 13 wherein the step of operating the electronic control mechanism to monitor the operation of the mechanical firing mechanism comprises recording the number of times the mechanical firing mechanism is operated.

15. The method of claim 12 further comprising the step of operating the electronic control mechanism to alter an operating parameter of the mechanical firing mechanism prior to operating the mechanical firing mechanism.

16. The method of claim 15 wherein the step of operating the electronic control mechanism to alter an operating parameter of the mechanical firing mechanism comprises operating a locking mechanism to simulate either 1. a misfire or jam in the firearm; or 2. the depletion of simulated ammunition within the simulated magazine.

17. The method of claim 12 wherein the steps of operating the mechanical firing mechanism to fire a simulated shot from the simulated firearm and of operating the electronic control mechanism to monitor the operation of the mechanical firing mechanism are synchronized.

* * * * *